US010288373B1

(12) United States Patent
Hardman et al.

(10) Patent No.: US 10,288,373 B1
(45) Date of Patent: May 14, 2019

(54) FIREARM WITH SEAR RETURN DELAY MECHANISM

(71) Applicant: Ohio Ordnance Works, Inc., Chardon, OH (US)

(72) Inventors: Thomas M. Hardman, Chesterland, OH (US); Robert W. Landies, III, Chardon, OH (US); Joshua G. Hershberger, Concord Township, OH (US); Gary T. Hershberger, Middlefield, OH (US)

(73) Assignee: OHIO ORDNANCE WORKS, INC., Chardon, OH (US)

( * ) Notice: Subject to any disclaimer, the term of this patent is extended or adjusted under 35 U.S.C. 154(b) by 0 days.

(21) Appl. No.: 15/845,316

(22) Filed: Dec. 18, 2017

(51) Int. Cl.

| | |
|---|---|
| ***F41A 19/04*** | (2006.01) |
| ***F41A 19/33*** | (2006.01) |
| ***F41A 19/46*** | (2006.01) |
| ***F41A 19/12*** | (2006.01) |

(52) U.S. Cl.
CPC ..... *F41A 19/12* (2013.01); *F41A 19/04* (2013.01); *F41A 19/33* (2013.01); *F41A 19/46* (2013.01)

(58) Field of Classification Search
CPC ..... F41A 19/04; F41A 19/12; F41A 19/33; F41A 19/46
See application file for complete search history.

(56) References Cited

U.S. PATENT DOCUMENTS

| | | | | |
|---|---|---|---|---|
| 3,918,347 | A * | 11/1975 | Pierre | F41A 19/33 89/141 |
| 5,770,814 | A * | 6/1998 | Ealovega | F41A 19/04 89/131 |
| 8,001,881 | B2 * | 8/2011 | Sy | F41A 19/04 89/131 |
| 8,899,141 | B2 * | 12/2014 | Reynolds | F41A 5/12 89/129.01 |

FOREIGN PATENT DOCUMENTS

RU 2219458 C1 * 12/2003

* cited by examiner

*Primary Examiner* — Joshua T Semick
(74) *Attorney, Agent, or Firm* — Renner Kenner Greive Bobak Taylor & Weber

(57) ABSTRACT

A firearm includes a sear with a sear tip, the sear movable between a stop-fire position, wherein a discharge mechanism is held by the sear tip against movement that would result in firing of a round, and a fire position, wherein the discharge mechanism is released by the sear tip to permit movement of the discharge mechanism to fire a round. The firearm includes a sear return delay mechanism delaying the return of the sear tip to the stop-fire position from the fire position.

19 Claims, 10 Drawing Sheets

FIREARM WITH SEAR RETURN DELAY MECHANISM

FIELD OF THE INVENTION

This invention relates to a firearm having a sear return delay mechanism for delaying the return of the sear from a fire position to a stop-fire position. In some embodiments, the sear return delay mechanism and other trigger components are provided as part of a trigger assembly removable from and mountable to a receiver of the firearm. In some embodiments, the sear return delay mechanism delays the movement of the sear from an operating rod (op rod) release position to an op rod catch position. In some embodiments, the sear delay mechanism is employed with op rods having a single sear notch, and, in other embodiments, is employed with op rods having two sear notches. In a particular embodiment, the sear return delay mechanism is employed in a M249 rifle including a select fire mechanism that permits the gun to be selectively operated to be either fully automatic or semi automatic.

BACKGROUND OF THE INVENTION

The present invention can be applied in any firearm having a sear moved between a stop-fire position, in which a discharge mechanism of the firearm is held by the sear tip against movement that would result in firing of a round, and a fire position, in which the discharge mechanism is released by the sear tip to permit movement of the discharge mechanism to fire a round. In the detailed embodiment shown, the present invention finds particular application in rifles in which the sear of a rifle engages a sear notch on the operating rod (op rod) to hold back the op rod until sufficient pressure is applied to the rifle's trigger to release the op rod and permit its cycling. These rifles include those that operate only in semi-automatic mode, those that operate in fully-automatic mode, and those that have the ability to be selectively switched from semi-automatic to fully automatic mode. In semi-automatic mode, the sear returns to its stop-fire position to again hold the op rod after the firing of a single round, and a trigger mechanism must be actuated to fire another round. In fully automatic mode, the sear remains out of a stop-fire position as long as the trigger mechanism remains actuated, and the sear only returns to its catch position upon release of the trigger. It has been found that the return of the sear can be too quick in some instances, presenting room for improvement of the return mechanics.

In all of these rifles, the sear tip often rubs against a length of the op rod before engaging with the sear notch. This can cause undesirable wear to the sear tip and the op rod. Any appreciable decrease in the length of the rub between the sear tip and op rod during a firing cycle will reduce wear.

Some rifles are provided with select fire assemblies that permit the rifle to be operated to be either fully automatic or semi-automatic. General examples are found in U.S. Pat. Nos. 8,453,554 and 8,459,172, which specifically address M60 and M249 rifles. One aspect of these rifles is that they have op rods with two sear notches, a primary sear notch and a safety sear notch. The safety sear notch is provided in many fully automatic rifles in order to avoid runaway in the instance of ammunition not driving the op rod back far enough, whether due to weak/faulty ammunition or a fouled gas tube or op rod, either of which can prevent the op rod from being driven back far enough during a firing cycle to engage the primary sear notch with the sear. The safety notch is placed so that the sear can engage it even though the op rod is not forced back as far as it should be under normal, proper operation. It has been found that, when in semi-automatic firing mode, the sear can return to the stop-fire position from the fire position so quickly that it will engage the rearward sear notch and stop the op rod before the firing of a round. This prevents the successful implementation of such select fire trigger assemblies (and similarly functioning apparatus) in rifles having op rods with two sear notches. This problem specifically led to the development of the present invention, but the invention, again, can be implemented in any desired firearm where it is believed benefits could be derived from a delay in the sear return.

Thus, there is a need in the art for delaying the return of a sear to its notch-engaging or stop-fire position.

SUMMARY OF THE INVENTION

A first embodiment of this invention provides a firearm including: a sear with a sear tip, the sear movable between a stop-fire position, wherein a discharge mechanism is held by the sear tip against movement that would result in firing of a round, and a fire position, wherein the discharge mechanism is released by the sear tip to permit movement of the discharge mechanism to fire a round; and a sear return delay mechanism delaying the return of the sear tip to the stop-fire position from the fire position.

A second embodiment provides a firearm as in any embodiment above, wherein the firearm further includes a biasing mechanism forcing the sear tip to the stop-fire position; a firing mechanism actuated to move the sear tip to the fire position against the force of the biasing mechanism and thereafter permit the sear tip to return toward the stop-fire position under the force of the biasing mechanism.

A third embodiment provides a firearm as in any embodiment above, wherein the sear must do work against the sear delay mechanism to return to the stop-fire position from the fire position.

A fourth embodiment provides a firearm as in any embodiment above, wherein the sear delay mechanism employs magnetic forces the sear must work against.

A fifth embodiment provides a firearm as in any embodiment above, wherein the sear delay mechanism includes a movable mass, and to return to the stop-fire position from the fire position the sear does work against the sear delay mechanism by moving the movable mass.

A sixth embodiment provides a firearm as in any embodiment above, wherein the movable mass is biased by a biasing element, and the sear must move the movable mass against the biasing element to return to the stop-fire position from the fire position.

A seventh embodiment provides a firearm as in any embodiment above, wherein the movable mass is rotatably mounted in the firearm proximate its center of mass, and the sear does work against the sear delay mechanism by rotating the movable mass.

An eighth embodiment provides a firearm as in any embodiment above, wherein the movable mass is rotatably mounted in the firearm, and the sear delay mechanism further includes: a cam plate pivotably mounted in the firearm and engaged with the movable mass such that pivoting of the cam plate results in pivotal movement of the movable mass, said cam plate having a cam track, wherein the sear includes a sear arm that moves upon movement of the sear and interacts with the cam track such that the sear arm pivots the cam plate as the sear moves from the fire position to the stop-fire position.

A ninth embodiment provides a firearm as in any embodiment above, wherein the sear arm interacts with the cam track through a cam pin that moves in the cam track.

A tenth embodiment provides a firearm as in any embodiment above, wherein the cam track provides a dead zone through which the cam pin moves as the sear moves from the stop-fire position to the fire position, the dead zone preventing movement of the movable mass by the interaction of the sear arm and the cam track, and preventing movement of the movable mass despite movement of the sear tip due to the op rod sliding over the sear tip.

An eleventh embodiment provides a firearm as in any embodiment above, wherein the cam track defines a protrusion, the cam pin engaging the protrusion and moving the cam plate by riding over the protrusion.

A twelfth embodiment provides a firearm as in any embodiment above, wherein the firearm includes a trigger assembly releasably connected to a receiver, the receiver carrying the discharge mechanism and the trigger assembly including: the sear, the sear return delay mechanism, the biasing mechanism, and the firing mechanism.

A thirteenth embodiment provides a firearm as in any embodiment above, wherein the firing mechanism includes a trigger engaged with the sear and, when engaged, pulled to move the sear tip to the fire position against the force of the biasing mechanism, the trigger thereafter disengaging from the sear to permit the sear tip to return toward the stop-fire position under the force of the biasing mechanism.

A fourteenth embodiment provides a firearm as in any embodiment above, wherein the sear must do work against the sear delay mechanism to return to the stop-fire position from the fire position.

A fifteenth embodiment provides a firearm as in any embodiment above, wherein the sear delay mechanism employs magnetic forces the sear must work against.

A sixteenth embodiment provides a firearm as in any embodiment above, wherein the sear delay mechanism includes a movable mass, and to return to the stop-fire position from the fire position the sear does work against the sear delay mechanism by moving the movable mass.

A seventeenth embodiment provides a firearm as in any embodiment above, wherein the movable mass is biased by a biasing element, and the sear must move the movable mass against the biasing element to return to the stop-fire position from the fire position.

An eighteenth embodiment provides a firearm as in any embodiment above, wherein the movable mass is rotatably mounted in the trigger assembly proximate its center of mass, and the sear does work against the sear delay mechanism by rotating the movable mass.

DETAILED DESCRIPTION OF ILLUSTRATIVE EMBODIMENTS

Figure 1:
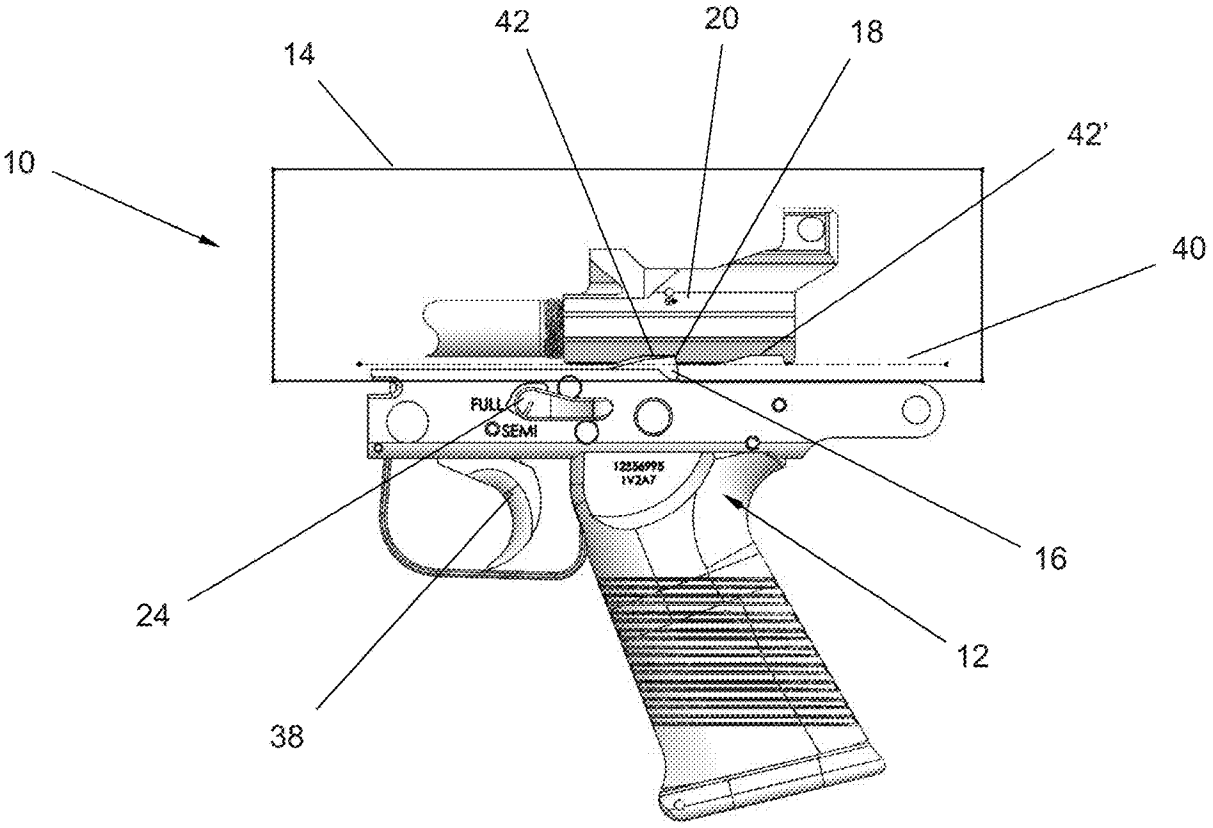
FIG. 1 is a left side elevational view, with portions shown schematically, of an M249 rifle, which serves as a non-limiting example of a firearm in which the sear delay mechanism concepts of this invention might be employed.

This invention relates to the use of a sear delay mechanism in a firearm having a discharge mechanism for firing a round. In some embodiments that discharge mechanism includes an op rod. In some embodiments, the sear delay mechanisms taught herein can be used in rifles having op rods with single sear notches or those having two or more sear notches. In particular embodiments, the sear delay mechanism is employed to delay the return of a sear so as to avoid catching on a rearward sear notch of an op rod having two sear notches, such as those found in an M249 rifle and M60 rifle, among others. In some embodiments the sear delay mechanism is part of a trigger assembly removably received by a receiver of a firearm, the receiver holding the discharge mechanism that serves to fire a round.

The present disclosure focuses on a particular assembly of components serving to move a sear to release a discharge mechanism and fire a round, but the present invention is not limited to or by any particular assembly. It will be readily apparent to those of ordinary skill in the art that the main focus of this invention is the delay of the return of the sear to its stop-fire position from its fire position. These positions are well known. In the stop-fire position, a discharge mechanism (such as a hammer or bolt or op rod or striker) is held by the sear tip against movement that would result in firing of a round. To fire a round, the sear tip is moved to the fire position by a trigger mechanism to release the discharge mechanism and permit movement of the discharge mechanism to fire a round. In the present example, the sear tip engages a sear notch in an op rod, but the present invention is applicable elsewhere for other firearms employing other discharge mechanisms.

A specific embodiment of the invention is shown in FIGS. 1-7 which show relevant portions of an M249 select fire rifle 10 (herein firearm 10) having a trigger housing 12 removably mating with a receiver 14. The trigger housing 12 holds the sear 16 and other trigger components necessary to move the sear tip 18 to allow for cycling of the op rod 20 to fire a round. The op rod 20 and other discharge mechanisms are held in the receiver 14. The trigger housing 12 connects to the receiver 14 so that the trigger assembly 22 (FIGS. 2-5) can communicate with the op rod 20 retained within the receiver 14. The trigger assembly 22 is manipulated to allow or prevent the reciprocation of the op rod assembly and hence allow or prevent firing.

Figure 2:
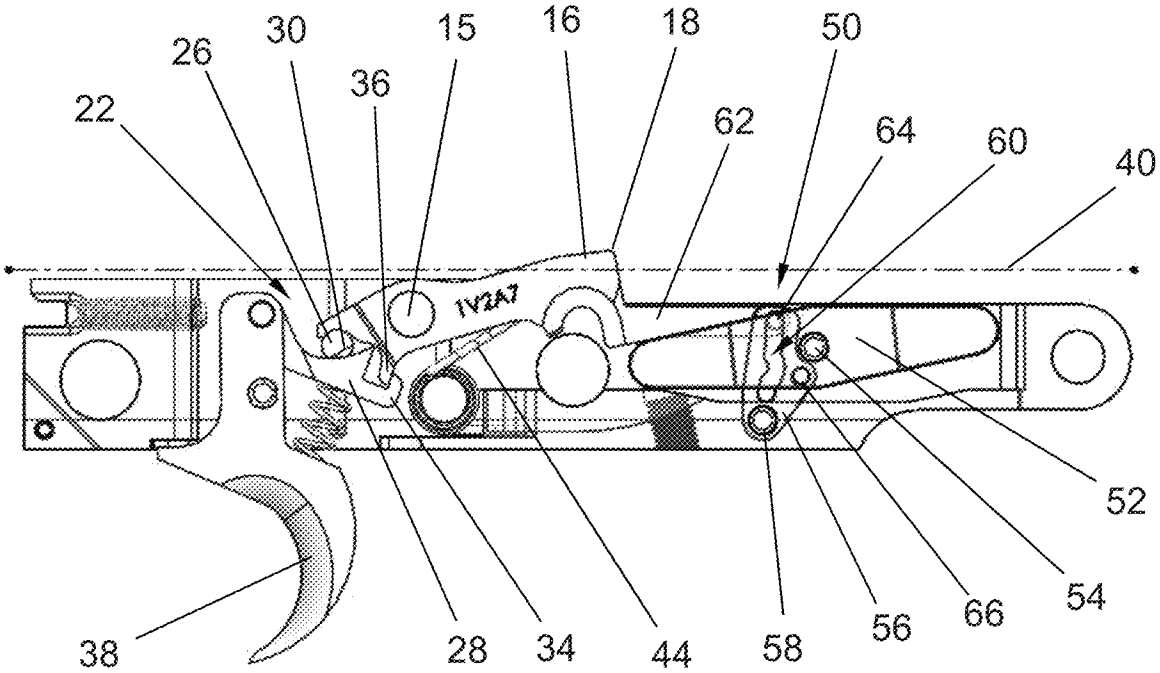
FIG. 2 is a left side elevational view of relevant components from the firearm of FIG. 1, with a particular embodiment of a sear delay mechanism of this invention incorporated therein, the firearm shown in fully automatic mode, with the trigger at rest, and the sear in a stop-fire position that prevents firing of a round.
Figure 3:
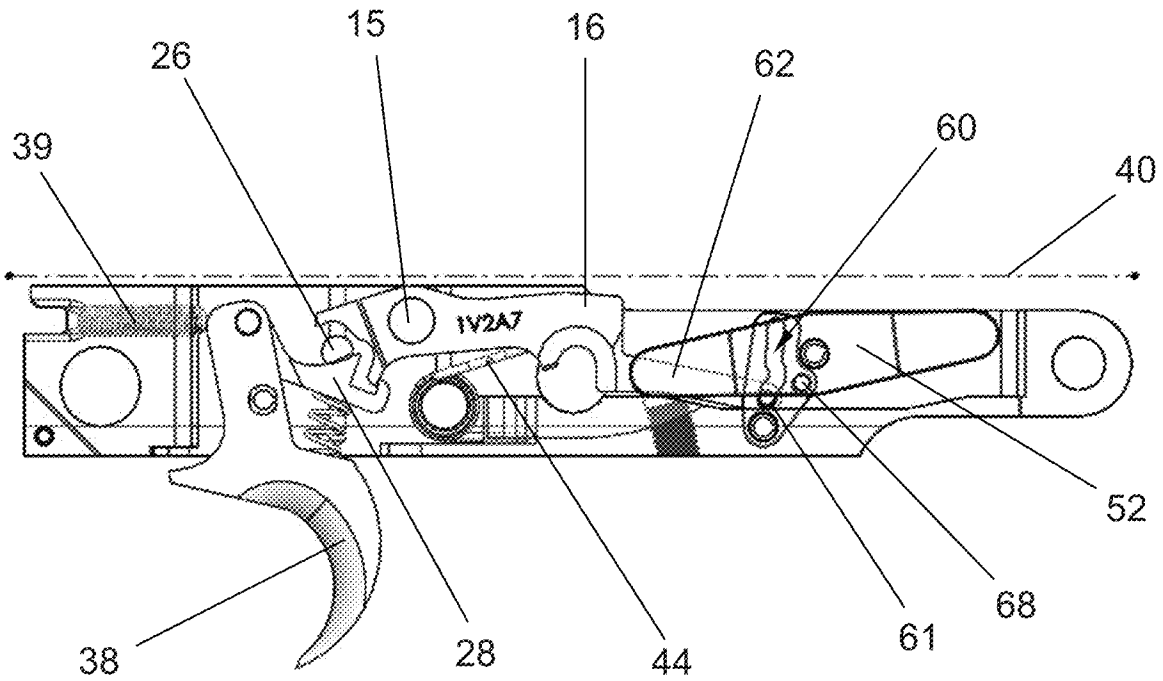
FIG. 3 is a left side elevational view as in FIG. 2, with the trigger pulled to place the sear in a fire position that permits firing of multiple rounds in fully automatic mode.
Figure 4:
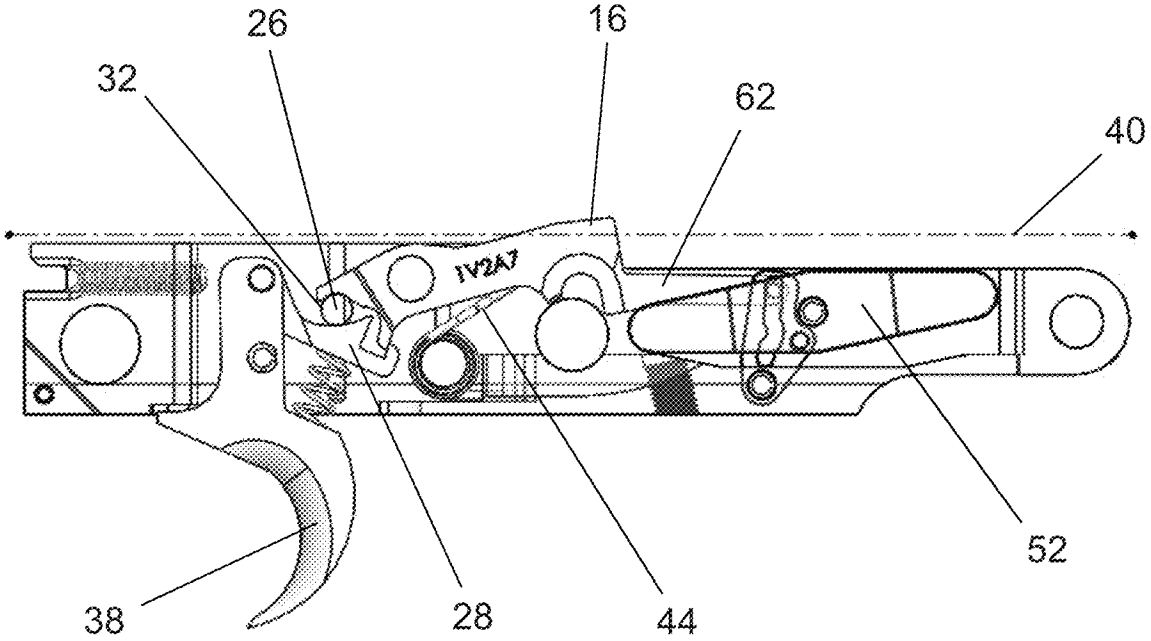
FIG. 4 is a left side elevational view as in FIG. 2, the firearm shown in semi-automatic mode, with the trigger at rest, and the sear in a stop-fire position that prevents firing of a round, and with a movable mass of the sear return delay mechanism at a rest position.

In FIGS. 2 and 3, the firearm 10 is shown in a fully automatic mode, wherein a switch 24 (FIG. 1) on the trigger housing 12 is moved to place a selector body 26 in position such that the disconnector 28 rests on an inset contact surface 30 thereof. In FIGS. 4-7, the firearm 10 is shown in a semi-automatic mode, wherein the switch 24 is moved to place the selector body 26 in position such that the disconnector 28 rests on a peripheral contact surface 32 thereof. The disconnector 28 provides a catch 34 (FIG. 2) that, in both modes, pulls on the lever arm 36 (FIG. 2) of the sear 16 upon pulling of the trigger 38, thus pulling the sear tip 18 out of the path 40 of the op rod 20, and, more particularly, out of engagement with the sear notch 42 on the underside of the op rod 20. This is shown in FIG. 3 (fully automatic) and FIG. 5 (semi-automatic), which show a fire position of the sear 16 (i.e. wherein the op rod 20 is released by the sear tip 18 to permit movement of the op rod 20 to fire a round). FIGS. 2 and 4 show the stop-fire position of the sear 16 (i.e., wherein the op rod 20 is held by the sear tip 18 against movement that would result in firing of a round). To simplify the disclosure, the op rod 20 is removed in the images in favor of simply showing the path 40 of the op rod 20, where the sear tip 18 would engage with or disengage from the sear notch 42. In comparing the fire position of the fully automatic mode (FIG. 3) with the fire position of the semi-automatic mode (FIG. 5), it is seen that the difference in how the disconnector 28 contacts the selector body 26 (whether surface 30 or 32) results in the different firing modes.

In fully automatic (FIG. 3), the disconnector 28 rides a bit higher, and, as a result, the catch 34 remains engaged with the lever arm 36 of the sear 16 and thus holds the sear tip 18 out of the path 40 until the trigger 38 is released. In distinction, in semi-automatic mode, the disconnector 28 rides lower, and, as a result, the catch 34 disengages from the lever arm 36 of the sear 16 directly after pulling the sear tip 18 out of the path 40, thus permitting the sear 16 to return to the stop-fire position under the influence of the sear spring 44. A spring is shown, but any biasing mechanism can be employed. More particulars of this specific select fire concept and structure is shown and disclosed in U.S. Pat. No. 8,459,172. Problems with its functioning led to the development of the present invention, but as noted, this invention and the sear return delay concepts herein are applicable to any firearm 10 that might benefit from a delay in the time it takes for the sear to return to the stop-fire position from the fire position.

With reference back to FIG. 1, it is seen that the M249 rifle (firearm 10) has an op rod 20 with two sear notches, a first sear notch already shown and designated by 42, and a second sear notch shown and designated by numeral 42'. With the understanding that the M249 rifle was originally designed to function only in the fully automatic mode, the second sear notch 42' is provided as a safety measure (as mentioned in the Background above), and, in normal operation, the sear tip 18 should engage the first sear notch 42 upon release of the trigger 20. However, after incorporating the select-fire trigger assembly into the M249 rifle it was found that, in semi-automatic mode, the sear tip 18 could return to path 40 so quickly as to catch the second sear notch 42' and stop the op rod 20 from causing the firing of a round. Two trigger pulls were often required to fire a round—a first pull to disengage the sear tip 18 from the first sear notch 42, and a second pull to disengage the sear tip 18 from the second sear notch 42'. The present invention was developed in solving this problem, and is thus disclosed specifically in relation to a firearm 10 being a select fire M249 rifle. The invention is not limited to or by such an application.

Figure 8:
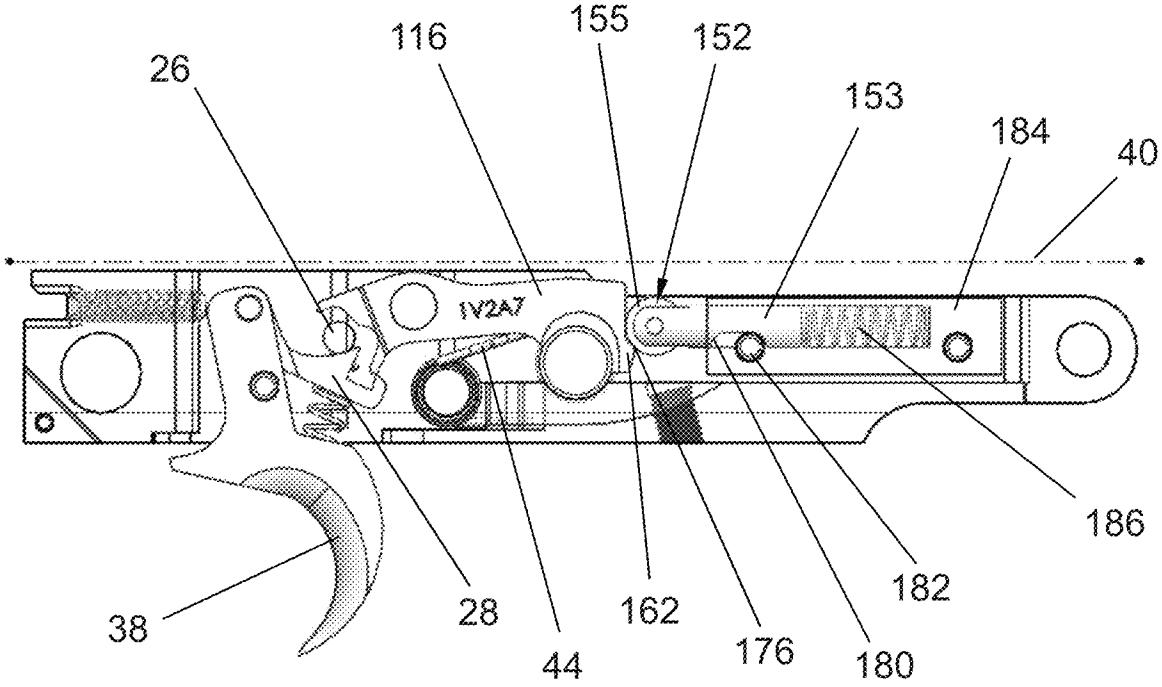
FIG. 8 is a schematic representation of another embodiment of a sear return delay mechanism.
Figure 9:
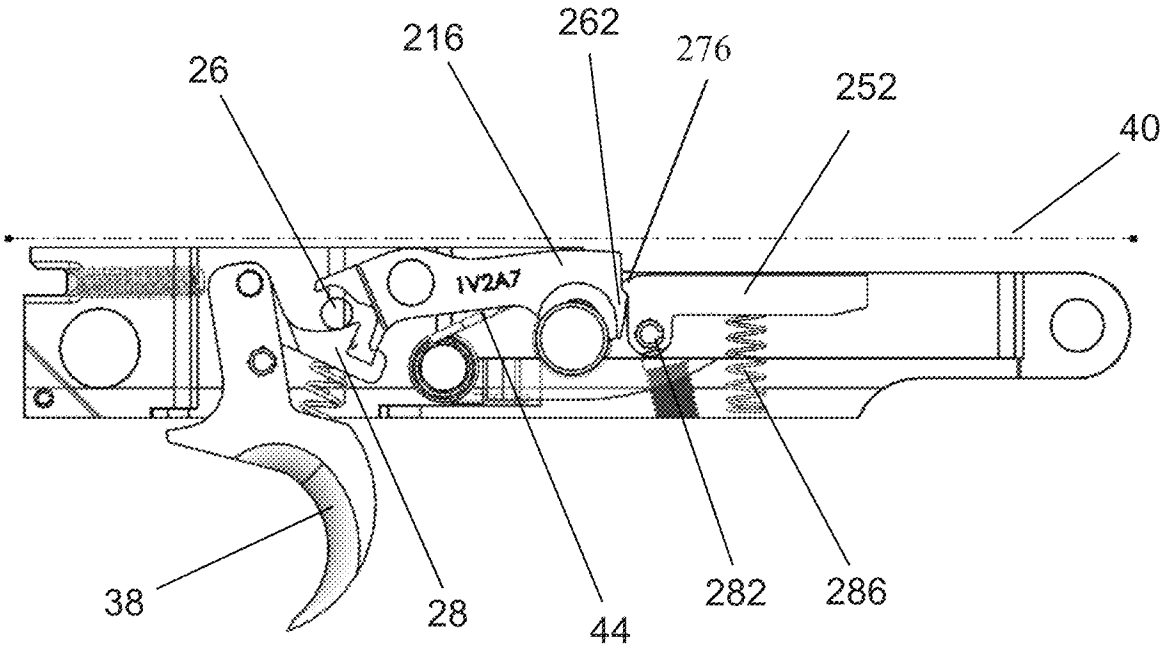
FIG. 9 is a schematic representation of yet another embodiment of a sear return delay mechanism.
Figure 10:
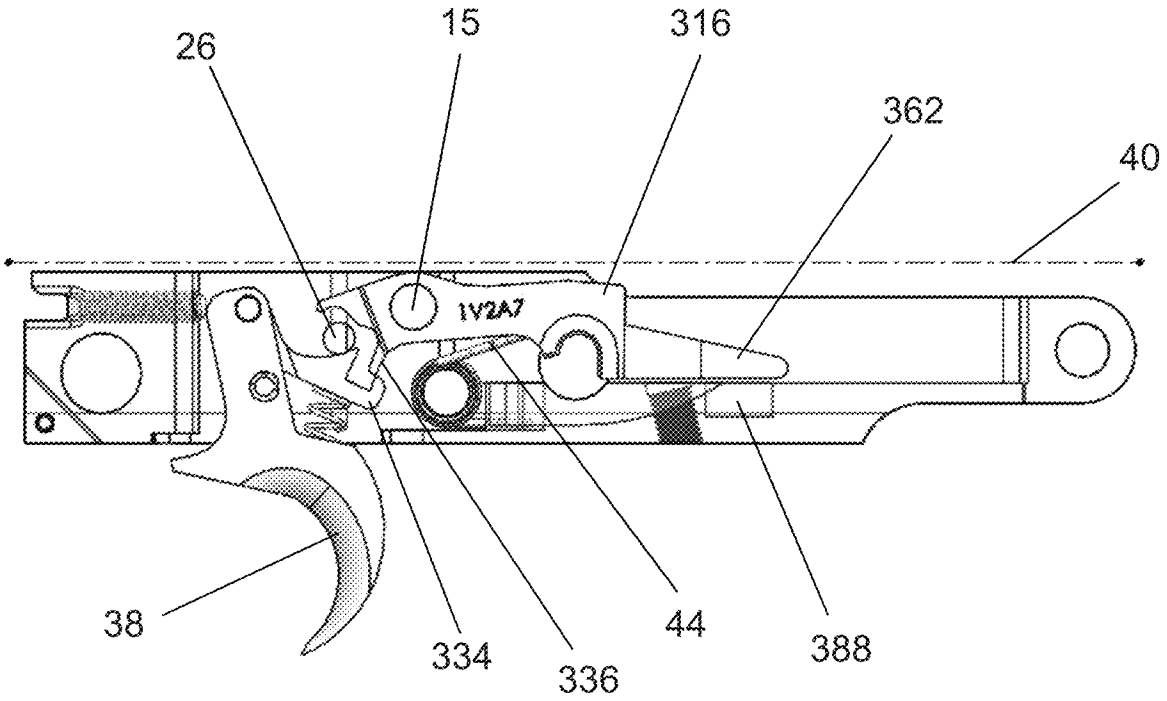
FIG. 10 is a schematic representation of yet another embodiment of a sear return delay mechanism, employing magnetic forces.

This invention provides various concepts for a sear return delay mechanism that serves to delay return of the sear tip to the stop-fire position from the fire position. In some embodiments, the sear must do work against the sear return delay mechanism to return to the stop-fire position from the fire position. In the specific embodiment of FIGS. 1-7, the sear return delay mechanism 50 (FIG. 2) includes a movable mass 52, and the sear 16 interacts with this movable mass 52 such that, to return to the stop-fire position from the fire position, the sear 16 must work against the sear delay mechanism 50 by moving the movable mass 52. In some embodiments, the movable mass 52 is rotatably mounted in the firearm 10, as at pin 54 (FIG. 2), and the sear 16 does work against the sear return delay mechanism 50 by rotating the movable mass 52. This is shown in FIGS. 2-7. Other structures are shown in FIGS. 8-10, and disclosed in relevant part herein below.

In some embodiments, such as in FIGS. 2-7, the movable mass 52 is rotatably mounted to rotate about an axis, and the movable mass is not forced in any direction by any spring or other load. The mass simply moves about an axis of rotation and causes resistance to movement in light of its mass. The movable mass 52 has a mass sufficient to slow the return of the sear 16 to the stop-fire position by a desired amount of time. In this specific example, the desired amount of time is sufficient to avoid a situation where the sear tip 18 catches the second sear notch 42' upon semi-automatic fire, as mentioned above to be a specific problem with such select fire M249 rifles.

In some embodiments, the movable mass 52 is rotatably mounted to pivot about an axis of rotation, as at pin 54, proximate its center of mass, to provide a well-balanced sear return delay mechanism 50. When mounted about its center of mass, the movable mass 52 balances about its center of rotation, and the sear return delay mechanism 50 is less affected by orientation of the firearm 10. This is particularly true when the movable mass 52 is not spring loaded, and, in the specific embodiment of FIGS. 2-7, the movable mass 52 is both rotatably mounted proximate its center of gravity and not forced in any direction by any spring or other load. The only forces on the movable mass 52 are gravity and the forces placed on it by movement of the sear 16.

The sear return delay mechanism 50 further includes a cam plate 56 (FIG. 2) pivotably mounted in the firearm 10, about an axis of rotation, at a pin 58. The cam plate 56 is operatively connected with the movable mass 52 such that pivoting of the cam plate 56 results in rotation of the movable mass 52. In this embodiment, the cam plate 56 provides a cam track 60, and the sear 16 includes a sear arm 62 that moves upon movement of the sear 16. This sear arm 62 interacts with the cam track 56 such that the sear arm 62 pivots the cam plate 56 as the sear 16 moves from the fire position (FIG. 5) to the stop-fire position (FIG. 4). The movement of the movable mass 52 is more fully disclosed in the following description of the actuation of the firing mechanism, here through a trigger 38, as shown in FIGS. 4-7.

In FIG. 4, the firearm is at rest, with the trigger 38 at its rest position and the sear 16 fully engaged with the op rod 20, which is represented in FIG. 4 by the extension of sear tip 18 into the path 40 of the op rod 20. The sear arm 62 includes a cam pin 64 that moves in the cam track 60 of the cam plate 56. Offset from the axis of rotation of the cam plate 56 (as defined by the pin 58), the cam plate 56 mates with the movable mass 52 at a position on the movable mass 52 that is offset from its axis of rotation (as defined at pin 54). In this particular embodiment, the cam plate 56 includes an aperture 66 (FIG. 2) that receives a pin 68 (FIG. 3) extending from the movable mass 52, but the invention is not limited to or by such specific structures. When the cam plate 56 is rotated by the interaction of the cam pin 64 and the cam track 60, the movable mass 52 is also rotated.

The sear return delay mechanism 50 is designed so that the sear 16 must do work upon the movable mass 52 as the sear returns to the stop-fire position from the fire position. The cam track 60 can be oriented and structured in various ways to translate movement of the sear arm 62 into movement of the movable mass 52. A particular cam track structure that provides a particular type of movement of the movable mass 32 is next disclosed.

Figure 5:
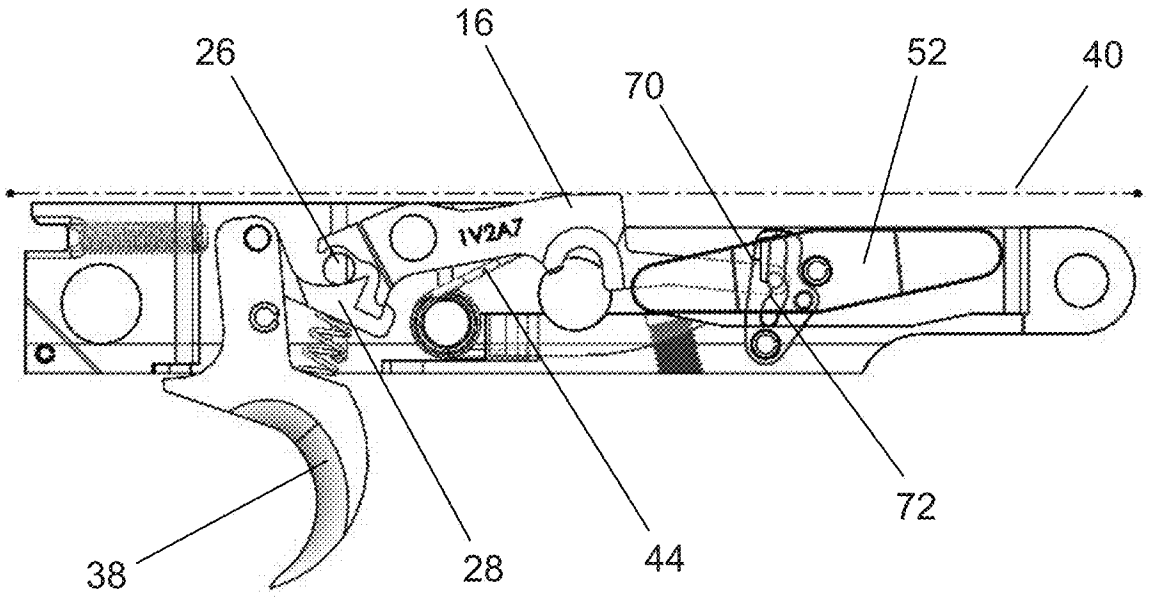
FIG. 5 is a left side elevational view as in FIG. 2, the firearm shown in semi-automatic mode, with the trigger pulled to place the sear in a fire position that permits cycling of the op rod (discharge mechanism), and the movable mass of the sear return delay mechanism beginning to move under the influence of the motion of the sear.

In comparison of FIGS. 4 and 5, the trigger 38 has been pulled in FIG. 5 such that, in light of the pivot points for and connections between the trigger 38 and the disconnector 28, the disconnector 28 is pulled forward. The catch 34 of the disconnector 28 pulls on the lever arm 36 of the sear 16, causing the sear 16 to pivot about axis 15, eventually arriving at the position of FIG. 5, wherein the sear tip 18 is removed from the path 40 (i.e., removed from the sear notch of the op rod 20 to permit single-fire cycling). The sear delay mechanism 50, in this particular firearm, serves a purpose of preventing the sear tip 18 from returning to path 40 so quickly as to catch the second sear notch 42'.

Figure 6:
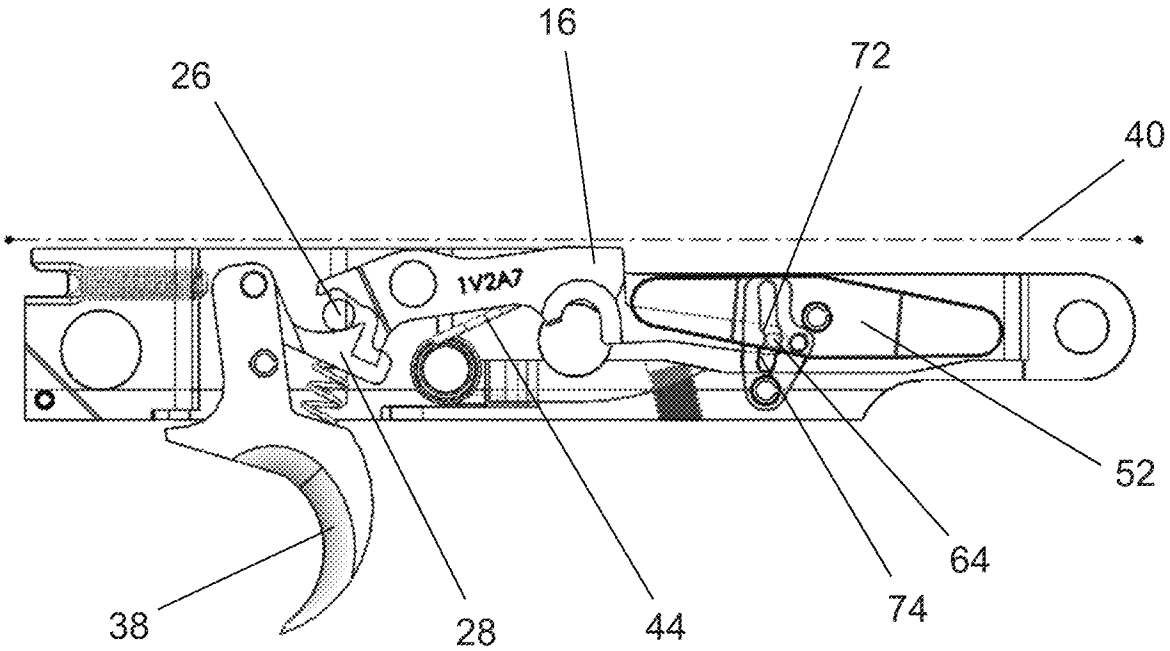
FIG. 6 is a left side elevational view as in FIG. 2, the firearm shown in semi-automatic mode, with the trigger further pulled as the op rod begins its cycle, the movable mass of the sear return delay mechanism being fully displaced in a first direction due to interaction of the sear with a cam plate joining to the movable mass.
Figure 7:
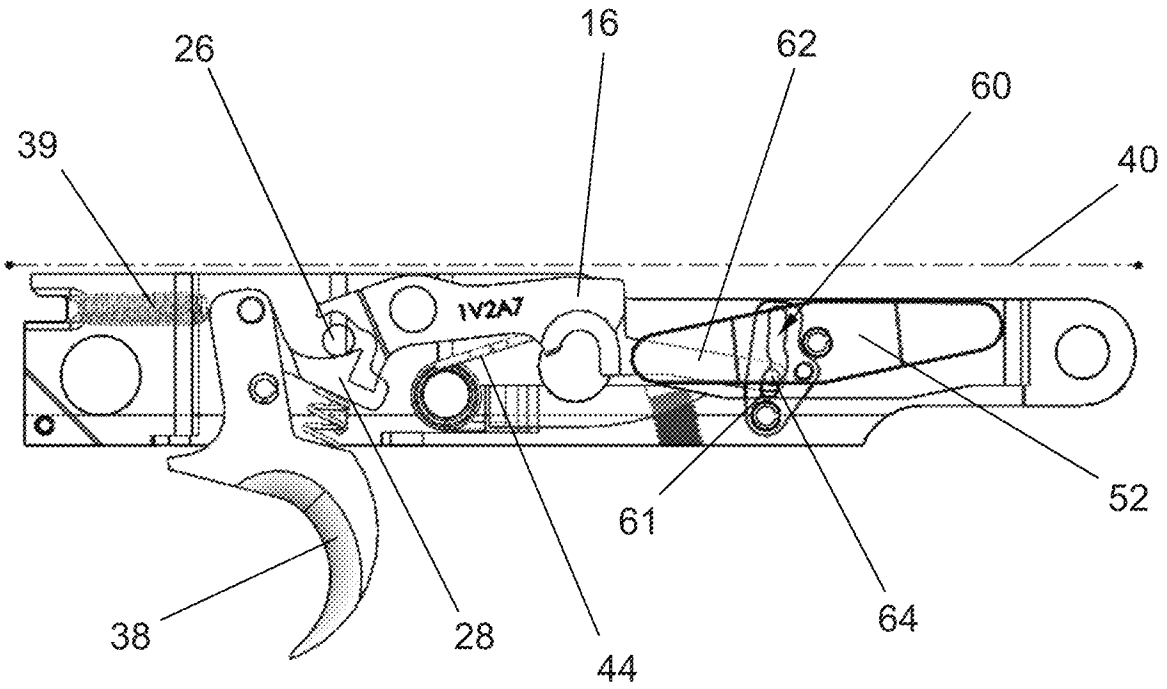
FIG. 7 is a left side elevational view as in FIG. 2, the firearm shown in semi-automatic mode, with the trigger yet further pulled as the op rod continues to cycle, the movable mass of the sear return delay mechanism being returned to its rest position, and the sear being released by the disconnector of the trigger assembly such that the sear will next return to the stop-fire position under the influence of a biasing member and do work against the movable mass to rotate it through the cam plate.

In the position FIG. 5, the catch 34 is still engaged with the lever arm 36, but, having disengaged from the sear notch 42, significant resistant force has been removed, and the remaining trigger pull, from FIG. 5 to FIG. 6 and then to FIG. 7, occurs quite quickly for most shooters. From the position of FIG. 7, where the disconnector 28 disconnects from the lever arm 36, the sear 16 returns towards the stop-fire position under the influence of the sear spring 44, and the cam pin 64 causes rotation of the movable mass 52 in light of its interaction with the cam track 60.

In some embodiments, from the position of FIG. 4 (stop-fire position) to the position of FIG. 5 (fire position) the cam pin 64 rides in a dead zone 70 of the cam track 60. The dead zone 70 is so named because it is structured to prevent pivoting of the movable mass 52 despite the movement of the sear arm 62 and the cam pin 64. The dead zone 70 prevents pivoting of the cam plate 56 by the sear arm 62. In such embodiments, the return of the op rod 20 will push the sear 16 down below the path 40 as the op rod 20 slides over the sear tip 18, but the continued return of the sear tip 18 into the path 40 will not be delayed by the movable mass 52. In essence, this dead zone 70 prevents the the movable mass 52 from being affected merely by op rod travel, and it is the trigger or other firing mechanism that affects the movable mass 52.

As the trigger 38 is further pulled, and the sear 16 is pivoted further downardly, the cam pin 64 engages and rides on a protrusion 72 in the cam track 60, the protrusion 72 extending rearwardly such that the cam plate 56 is rotated forwardly (or counterclockwise in the orientation of FIG. 6). This movement of the cam plate 56 causes clockwise movement of the movable mass 52 in light of the interaction of pin 68 and aperture 66. At the position of FIG. 6, the disconnector 28 is still engaged with the lever arm 36 of the sear 16, but the trigger 38 is pulled further in the act of firing a round such that the trigger 38 and sear 16 and sear return delay mechanism 50 continued to move to the position of FIG. 7. In FIG. 7, the cam pin 64 has traveled over the protrusion 72 to settle into a valley 74 in the cam track 60, the valley 74 being positioned such that the cam plate 56 moves rearwardly (clockwise) sufficient to return the movable mass 52 to the same position it is at in rest (FIG. 4). In the position of FIG. 7, the disconnector 28 also disconnects from the lever arm 36 of the sear 16. Thus, from the position of FIG. 7, the sear 16 is urged back to the stop-fire position under the influence of the sear spring 44, and the movable mass 52 is moved to the position of FIG. 6 and then back to the rest position as the cam pin 64 returns to its rest position of FIG. 4 after traveling over the protrusion 72 and through the dead zone 70. The sear 16 thus does work against the weight of the moveable mass 52 to move it clockwise and then counterclockwise through the interaction of the cam pin 64 and the cam track 60, and this delays the sear sufficiently to avoid the second sear notch 42'.

The travel length of the trigger 38 is limited by a travel stop 39 that is positioned so the trigger 38 must stop its travel before the cam pin 64 presses against end 61 of the cam track 60. In FIG. 7, the trigger 38 is shown at the point of release of the sear 14, and almost fully pulled, with the firearm in the semi-automatic mode, and the travel stop 39 will stop the cam pin 64 before it reaches end 61. In FIG. 3, where the trigger 38 is shown fully pulled, with the firearm 10 in fully automatic mode, the travel stop 39 stops travel just before the cam pin 64 has reached end 61. In some embodiments, the cam track 60 (and other relevant components) is structured to avoid a situation where, in fully automatic mode, the cam pin 64 bottoms out at end 61 before a full trigger pull. If permitted to bottom out in this manner, the shooter can place stress on the cam plate 56 by squeezing the trigger 38 so that cam pin 64 presses strongly against end 61.

Once again, the present invention is not limited to or by the specific embodiment in an M249 rifle, wherein the sear return delay mechanism provides a particular desired function to avoid a second sear notch. The concepts in the present invention can be implemented in other firearms with different trigger assemblies and discharge mechanisms.

The sear delay can be achieved in a number of ways, as shown, by way of example in FIGS. 8 and 9. In FIGS. 8 and 9, the trigger mechanisms are not shown. Instead, a sear is shown interacting with a sear return delay mechanism with the understanding that the sear rotates downwardly (clockwise) upon actuation of a firing mechanism to clear the path of the op rod and reach a firing position, and then travels upwardly (counterclockwise) to the stop-fire position, with the sear return delay mechanism being moved by contact between a movable mass thereof and an arm of the sear.

In some embodiments, the movable mass is biased by a biasing member, and, whether moving linearly (as in FIG. 8) or rotationally (FIG. 9), the sear does work against the sear delay mechanism by moving the movable mass linearly (FIG. 8) or rotationally (FIG. 9) as the sear returns to the stop-fire position.

In FIG. 8, the sear 116 engages a movable mass 152 at a sear arm 162. The sear arm 162 is not operatively connected with the moveable mass 152 (as in the case of the embodiment of FIGS. 2-7), but rather simply contacts a distal end 176 of the movable mass 152. The movable mass 152 includes a shaft 153 holding a wheel 155, the shaft 153 having a cut-out 180 for a pin 182 to hold the shaft 153 in place and limit its movement. The shaft 153 can reciprocate against a housing 184 and biasing element 186 serving to urge the movable mass 152 toward the sear 116. It can be seen that, upon the pulling the sear 116 downwardly to fire a round (as shown in FIG. 8), the movable mass 152 will move leftwardly presenting its wheel 155 above the sear arm 162. To return to the stop-fire position, the sear 116 must move upwardly, causing the sear arm 162 to press against the wheel 155 and urge the movable mass 152 rearwardly against the biasing element 186. The sear must therefore do work against the movable the mass in order to return to the stop-fire position, and this slows the return of the sear. The biasing element is shown as a spring but can be any element that resists movement of the movable mass 152.

In the embodiment of FIG. 9, the sear 216 engages a movable mass 252 at a sear arm 262. The sear arm 262 is not operatively connected with the moveable mass 252 (as in the case of the embodiment of FIGS. 2-7), but rather simply contacts a distal end 276 of the movable mass 252. The movable mass 252 is rotatably mounted as at a pin 282, and a biasing element 286, here shown as a compression spring, serves to urge the movable mass 252 toward the sear 216. It can be seen that, upon the pulling the sear 216 downwardly to fire a round (as shown in FIG. 9), the movable mass 252 will rotate leftwardly (counterclockwise) presenting its distal end 276 above the sear arm 262. To return to the stop-fire position, the sear 216 must move upwardly, causing the sear arm 262 to press against the distal end 276 and urge the movable mass 252 clockwise against the biasing element 286. It can be seen that the distal end 276 and the sear arm 262 can interact through abutting protrusions, as shown. The sear must therefore do work against the movable the mass in order to return to the stop-fire position, and this slows the return of the sear. The biasing element is shown as a spring but can be any element that resists movement of the movable mass 252.

In FIG. 10, magnetic forces are employed to slow the return of the sear. The sear 316 is shown directly at the position where the lever arm 336 is released from the catch 334, and the sear tip 318 is outside path 40 to allow firing of a round. The sear arm 362 is in close proximity to a magnet 388 that attracts the sear arm 362 (which is ferromagnetic) and thus delays its return beyond what would be experience without the magnet 338. To return to the stop-fire position, the sear 316 must move upwardly, drawing the sear arm 362 away from the magnet 388. The sear 316 must therefore do work against the magnet in order to return to the stop-fire position, and this slows the return of the sear. The magnetic force could be introduced by current alternatively to magnets.

Referring back to FIGS. 1-7, in some embodiments the sear delay mechanism is part of a trigger assembly removably received by a receiver of a firearm, the receiver holding the discharge mechanism that serves to fire a round. In such embodiments, the trigger assembly includes the sear, the sear return delay mechanism, the biasing mechanism forcing the sear tip to the stop-fire position, and the firing mechanism actuated to move the sear tip to the fire position against the force of the biasing mechanism and thereafter permit the sear tip to return toward the stop-fire position under the force of the biasing mechanism.

In light of the foregoing, it should be appreciated that the present invention significantly advances the art by providing for sear return delay mechanisms for firearms. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

The invention claimed is:

1. A firearm comprising:

a sear with a sear tip, the sear movable between a stop-fire position, wherein a discharge mechanism is held by the sear tip against movement that would result in firing of a round, and a fire position, wherein the discharge mechanism is released by the sear tip to permit movement of the discharge mechanism to fire a round;

a sear return delay mechanism delaying the return of the sear tip to the stop-fire position from the fire position;

a biasing mechanism forcing the sear tip to the stop-fire position; and a firing mechanism actuated to move the sear tip to the fire position against the force of the biasing mechanism and thereafter permit the sear tip to return toward the stop-fire position under the force of the biasing mechanism.

2. The firearm of claim 1, wherein the sear must do work against the sear return delay mechanism to return to the stop-fire position from the fire position.

3. The firearm of claim 2, wherein the sear return delay mechanism employs magnetic forces the sear must work against.

4. The firearm of claim 2, wherein the sear return delay mechanism includes a movable mass, and to return to the stop-fire position from the fire position the sear does work against the sear return delay mechanism by moving the movable mass.

5. The firearm of claim 4, wherein the movable mass is biased by a biasing element, and the sear must move the movable mass against the biasing element to return to the stop-fire position from the fire position.

6. The firearm of claim 4, wherein the movable mass is rotatably mounted in the firearm proximate its center of mass, and the sear does work against the sear return delay mechanism by rotating the movable mass.

7. The firearm of claim 4, wherein the movable mass is rotatably mounted in the firearm, and the sear return delay mechanism further includes:

a cam plate pivotably mounted in the firearm and engaged with the movable mass such that pivoting of the cam plate results in pivotal movement of the movable mass, said cam plate having a cam track, wherein the sear includes a sear arm that moves upon movement of the sear and interacts with the cam track such that the sear arm pivots the cam plate as the sear moves from the fire position to the stop-fire position.

8. The firearm of claim 1, wherein the firearm includes a trigger assembly releasably connected to a receiver, the receiver carrying the discharge mechanism and the trigger assembly comprising:

the sear, the sear return delay mechanism, the biasing mechanism, and the firing mechanism.

9. The firearm of claim 1, wherein the firearm is in a semi-automatic mode.

10. The firearm of claim 1, further comprising an op rod with a safety sear notch, and the sear return delay mechanism serves to delay the return of the sear tip to the stop-fire position so as to avoid the safety sear notch on the op rod as the op rod cycles forwardly to fire a round.

11. A firearm comprising:

a sear with a sear tip, the sear movable between a stop-fire position, wherein a discharge mechanism is held by the sear tip against movement that would result in firing of a round, and a fire position, wherein the discharge mechanism is released by the sear tip to permit movement of the discharge mechanism to fire a round; and a sear return delay mechanism delaying the return of the sear tip to the stop-fire position from the fire position;

wherein the sear must do work against the sear return delay mechanism to return to the stop-fire position from the fire position;

wherein the sear return delay mechanism includes a movable mass, and to return to the stop-fire position from the fire position the sear does work against the sear return delay mechanism by moving the movable mass;

wherein the movable mass is rotatably mounted in the firearm, and the sear return delay mechanism further includes:

a cam plate pivotably mounted in the firearm and engaged with the movable mass such that pivoting of the cam plate results in pivotal movement of the movable mass, said cam plate having a cam track, wherein the sear includes a sear arm that moves upon movement of the sear and interacts with the cam track such that the sear arm pivots the cam plate as the sear moves from the fire position to the stop-fire position, wherein the sear arm interacts with the cam track through a cam pin that moves in the cam track.

12. The firearm of claim 11, wherein the cam track provides a dead zone through which the cam pin moves as the sear moves from the stop-fire position to the fire position, the dead zone preventing movement of the movable mass by the interaction of the sear arm and the cam track, and preventing movement of the movable mass despite movement of the sear tip due to the op rod sliding over the sear tip.

13. The firearm of claim 12, wherein the cam track defines a protrusion, the cam pin engaging the protrusion and moving the cam plate by riding over the protrusion.

14. A firearm comprising:

a sear with a sear tip, the sear movable between a stop-fire position, wherein a discharge mechanism is held by the sear tip against movement that would result in firing of a round, and a fire position, wherein the discharge mechanism is released by the sear tip to permit movement of the discharge mechanism to fire a round;

a sear return delay mechanism delaying the return of the sear tip to the stop-fire position from the fire position;

a biasing mechanism forcing the sear tip to the stop-fire position;

a firing mechanism actuated to move the sear tip to the fire position against the force of the biasing mechanism and thereafter permit the sear tip to return toward the stop-fire position under the force of the biasing mechanism;

a trigger assembly releasably connected to a receiver, the receiver carrying the discharge mechanism, and the trigger assembly comprising:

the sear, the sear return delay mechanism, the biasing mechanism, and the firing mechanism, wherein the firing mechanism includes a trigger engaged with the sear and, when engaged, pulled to move the sear tip to the fire position against the force of the biasing mechanism, the trigger thereafter disengaging from the sear to permit the sear tip to return toward the stop-fire position under the force of the biasing mechanism.

15. The firearm of claim 14, wherein the sear must do work against the sear return delay mechanism to return to the stop-fire position from the fire position.

16. The firearm of claim 15, wherein the sear return delay mechanism employs magnetic forces the sear must work against.

17. The firearm of claim 15, wherein the sear return delay mechanism includes a movable mass, and to return to the stop-fire position from the fire position the sear does work against the sear return delay mechanism by moving the movable mass.

18. The firearm of claim 17, wherein the movable mass is biased by a biasing element, and the sear must move the movable mass against the biasing element to return to the stop-fire position from the fire position.

19. The firearm of claim 17, wherein the movable mass is rotatably mounted in the trigger assembly proximate its center of mass, and the sear does work against the sear return delay mechanism by rotating the movable mass.

* * * * *